US008911173B2

(12) United States Patent
Ulislam

(10) Patent No.: US 8,911,173 B2
(45) Date of Patent: Dec. 16, 2014

(54) PAVEMENT SLABS WITH SLIDING DOWELS

(71) Applicant: Jersey Precast Corporation, Inc., Hamilton Township, NJ (US)

(72) Inventor: Amir Ulislam, Neshanic Station, NJ (US)

(73) Assignee: Jersey Precast Corporation, Inc., Hamilton Township, NJ (US)

( * ) Notice: Subject to any disclaimer, the term of this patent is extended or adjusted under 35 U.S.C. 154(b) by 0 days.

(21) Appl. No.: 13/826,082

(22) Filed: Mar. 14, 2013

(65) Prior Publication Data

US 2014/0270947 A1 Sep. 18, 2014

(51) Int. Cl.

| | |
|---|---|
| ***E01C 5/00*** | (2006.01) |
| ***E01C 11/16*** | (2006.01) |
| *E04B 5/02* | (2006.01) |
| *E01C 11/18* | (2006.01) |

(52) U.S. Cl.

CPC ..... *E01C 5/005* (2013.01); *E01C 11/16* (2013.01); *E04B 5/02* (2013.01); *E01C 11/18* (2013.01)

USPC ..... 404/17; 404/21; 404/47; 404/56; 404/62; 52/223.6

(58) Field of Classification Search

CPC ..... E04F 11/16; E04B 5/02; E01C 11/16; E01C 11/18; E01C 5/005

USPC ..... 404/17, 21, 47–70; 52/223.1, 223.6, 52/223.7, 223.9, 223.11, 223.13, 250, 251, 52/319

See application file for complete search history.

(56) References Cited

U.S. PATENT DOCUMENTS

| | | | | |
|---|---|---|---|---|
| 1,991,931 | A | | 2/1935 | Kling et al. |
| 4,362,426 | A | | 12/1982 | Ruckstuhl |
| 5,586,834 | A | * | 12/1996 | Tsuji ..... 404/60 |
| 5,626,289 | A | | 5/1997 | Demers, Jr. |
| 5,682,635 | A | | 11/1997 | Tolliver |
| 5,797,231 | A | | 8/1998 | Kramer |
| 6,607,329 | B2 | | 8/2003 | Smith |
| 6,663,315 | B2 | | 12/2003 | Smith |
| 6,709,192 | B2 | | 3/2004 | Smith |
| 6,899,489 | B2 | | 5/2005 | Smith |
| 6,962,462 | B2 | | 11/2005 | Smith |
| 7,004,674 | B2 | | 2/2006 | Smith |
| 7,134,805 | B2 | | 11/2006 | Yee |
| 7,677,832 | B2 | | 3/2010 | Yee |
| 2002/0170259 | A1 | | 11/2002 | Ferris |
| 2007/0081858 | A1 | | 4/2007 | Yee |

OTHER PUBLICATIONS

Kwik Slab Interlocking Roadway Systems http://www.kwikslab.com/ Copyright 2006.

The Fort Miller Co., Inc. PO Box 98, Schuylerville, NY 12871, Super-Slab (TM) Precast Pavement Slab System (6 pages) obtained Aug. 7, 2012.

PCT International Search Report and Written Opinion PCT/US14/23546 International filing date Mar. 11, 2014, dated Sep. 11, 2014, 15 pages.

* cited by examiner

*Primary Examiner* — Raymond W Addie
(74) *Attorney, Agent, or Firm* — Greenberg Traurig, LLP

(57) ABSTRACT

A pavement slab including top and bottom surfaces, first and second longitudinal side surfaces, and first and second transverse side surfaces. The slab includes a first and second plurality of transverse holes formed within the first and second longitudinal side surfaces, respectively, a first and second plurality of longitudinal holes formed within the first and second plurality of transverse holes, respectively, and plurality of dowel bars. Each of the holes is sized and shaped to receive slidably a corresponding one of the plurality of dowel bars. Each of the dowel bars is slidable between a retracted position and an extend position in which the dowel bar forms a joint between the slab and another slab or preexisting pavement.

13 Claims, 6 Drawing Sheets

A-A

B-B

C-C

D-D

PAVEMENT SLABS WITH SLIDING DOWELS

FIELD OF THE INVENTION

The present invention relates to pavement slabs, and, more particularly, to pavement slabs with sliding dowel rods at joints.

BACKGROUND OF THE INVENTION

Pavement slabs are used in the construction, replacement and repair of facilities such as roadways, runways, parking areas, pathways and the like. The formation of strong and durable joints that interconnect adjacent pavement slabs is an important element in the construction and subsequent durability of such facilities. What is needed is a pavement slab joint interconnection system that produces strong and durable pavement slab joints between new to new as well as new to existing pavement sections.

SUMMARY OF THE INVENTION

In an embodiment, a pavement slab including a top surface, a bottom surface opposite the top surface, first and second longitudinal side surfaces, each of which extends from the top surface to the bottom surface, and first and second transverse side surfaces, each of which extends from the top surface to the bottom surface; a first plurality of transverse holes formed within the first longitudinal side surface, and a second plurality of transverse holes formed within the second longitudinal side surface; a first plurality of longitudinal holes formed within the first transverse side surface, and second plurality of longitudinal holes formed within the second transverse side surface; and a plurality of dowel bars, wherein each of the second plurality of transverse holes is sized and shaped to receive slidably a corresponding one of the plurality of dowel bars, and each of the second plurality of longitudinal holes is sized and shaped to receive slidably a corresponding one of the plurality of dowel bars, wherein each of the plurality of dowel bars positioned within its corresponding one of the second plurality of transverse holes is slidable between a retracted position, in which the dowel bar is positioned within its corresponding one of the second plurality of transverse holes, and an extracted position, in which one end of the dowel bar extends from its corresponding one of the second plurality of transverse holes and into a hole of a first external structure, and wherein each of the plurality of dowel bars positioned within its corresponding one of the second plurality of longitudinal holes is slidable between a retracted position, in which the dowel bar is positioned within its corresponding one of the second plurality of longitudinal holes, and an extracted position, in which one end of the dowel bar extends from its corresponding one of the second plurality of longitudinal holes and into a hole of a second external structure.

In an embodiment, a length of each of the second plurality of transverse holes is approximately one and one-half times a length of the corresponding one of the plurality of dowel bars positioned therein, and a length of each of the second plurality of longitudinal holes is approximately one and one-half times a length of the corresponding one of the plurality of dowel bars positioned therein. In an embodiment, each of the second plurality of transverse holes is formed approximately midway between the top surface and the bottom surface, and each of the second plurality of longitudinal holes is formed approximately midway between the top surface and the bottom surface. In an embodiment, the pavement slab further includes a plurality of pockets, each of which extends from the top surface to a corresponding one of the plurality of transverse holes. In an embodiment, the pavement slab further includes a plurality of slots, each of which extends from the top surface to a corresponding one of the plurality of longitudinal holes. In another embodiment, the pavement slab further includes a first plurality of pockets, each of which extends from the top surface to a corresponding one of the plurality of transverse holes, and a second plurality of pockets, each of which extends from the top surface to a corresponding one of the plurality of longitudinal holes. In another embodiment, the pavement slab further includes a first plurality of slots, each of which extends from the top surface to a corresponding one of the plurality of transverse holes, and a second plurality of slots, each of which extends from the top surface to a corresponding one of the plurality of longitudinal holes.

In an embodiment, each of the first plurality of transverse holes and each of the first plurality of longitudinal holes is sized and shaped to receive slidably a corresponding one of the plurality of dowel bars. In an embodiment, a length of each of the first plurality of transverse holes is approximately one-half times a length of the corresponding one of the plurality of dowel bars to be received therein, and a length of each of the first plurality of longitudinal holes is approximately one-half times a length of the corresponding one of the plurality of dowel bars to be received therein. In an embodiment, the pavement slab further includes a plurality of grout fill holes, each of which extends from the top surface to a corresponding one of the first and second plurality of transverse holes and the first and second plurality of longitudinal holes.

In an embodiment, the first and second external structures are second and third pavement slabs. In another embodiment, the first and second external structures are preexisting pavement.

In an embodiment, a pavement slab system includes a first pavement slab and a second pavement slab, each of the first and second pavement slabs including a top surface, a bottom surface opposite the top surface, first and second longitudinal side surfaces, each of which extends from the top surface to the bottom surface, and first and second transverse side surfaces, each of which extends from the top surface to the bottom surface, a first plurality of transverse holes formed within the first longitudinal side surface, and a second plurality of transverse holes formed within the second longitudinal side surface, a first plurality of longitudinal holes formed within the first transverse side surface, and second plurality of longitudinal holes formed within the second transverse side surface, and a plurality of dowel bars, wherein each of the first plurality of transverse holes and each of the first plurality of longitudinal holes is sized and shaped to receive slidably a corresponding one of the plurality of dowel bars, wherein each of the second plurality of transverse holes and each of the second plurality of longitudinal holes is sized and shaped to receive slidably a corresponding one of the plurality of dowel bars, and wherein each of the plurality of dowel bars positioned within its corresponding one of the second plurality of transverse holes of the first pavement slab is slidable between a retracted position, in which the dowel bar is positioned within its corresponding one of the second plurality of transverse holes, and an extracted position, in which one end of the dowel bar extends from its corresponding one of the second plurality of transverse holes and is positioned within a corresponding one of the first plurality of transverse holes of the second pavement slab.

In an embodiment, the pavement slab system further includes a third pavement slab, wherein each of the plurality of dowel bars positioned within its corresponding one of the second plurality of longitudinal holes of the first pavement slab is slidable between a retracted position, in which the dowel bar is positioned within its corresponding one of the second plurality of longitudinal holes, and an extracted position, in which one end of the dowel bar extends from its corresponding one of the second plurality of longitudinal holes and is positioned within a corresponding one of a first plurality of longitudinal holes of the third pavement slab.

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF THE DRAWINGS

Figure 1:
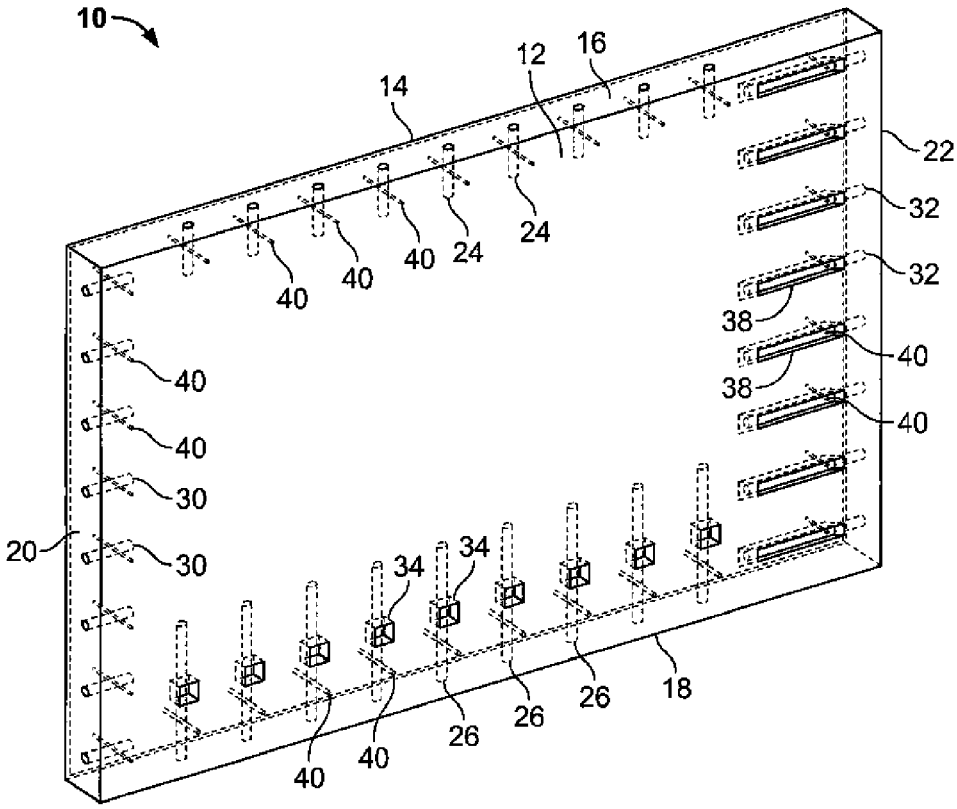
FIG. 1 is a perspective view of a pavement slab which is constructed in accordance with one embodiment of the present invention.
Figure 2:
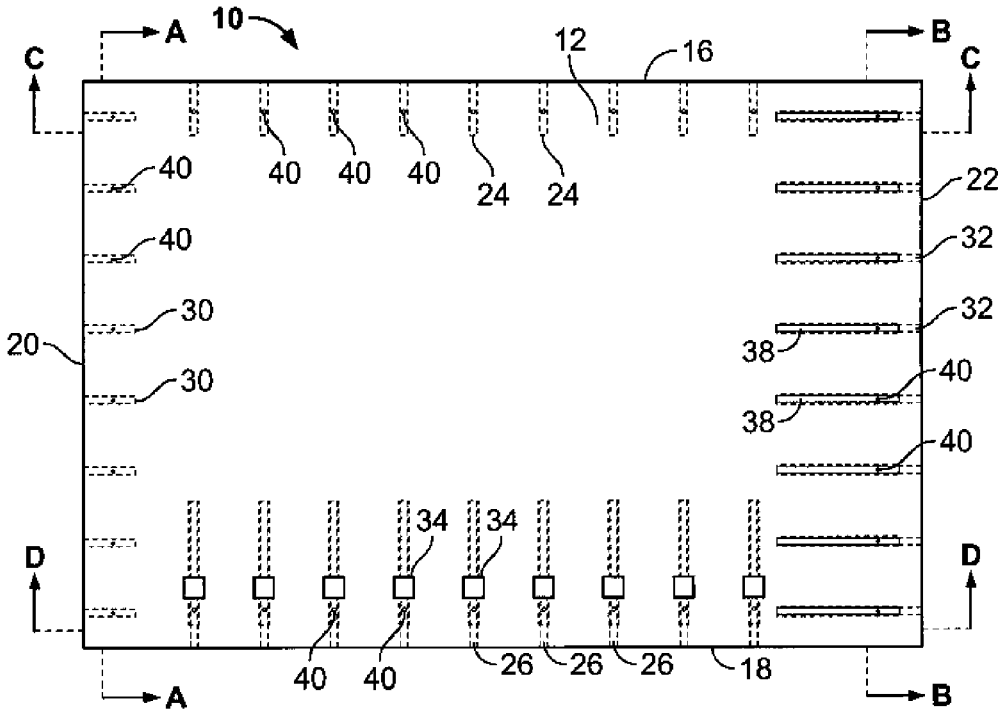
FIG. 2 is a top plan view of the pavement slab shown in FIG. 1.
Figure 3:
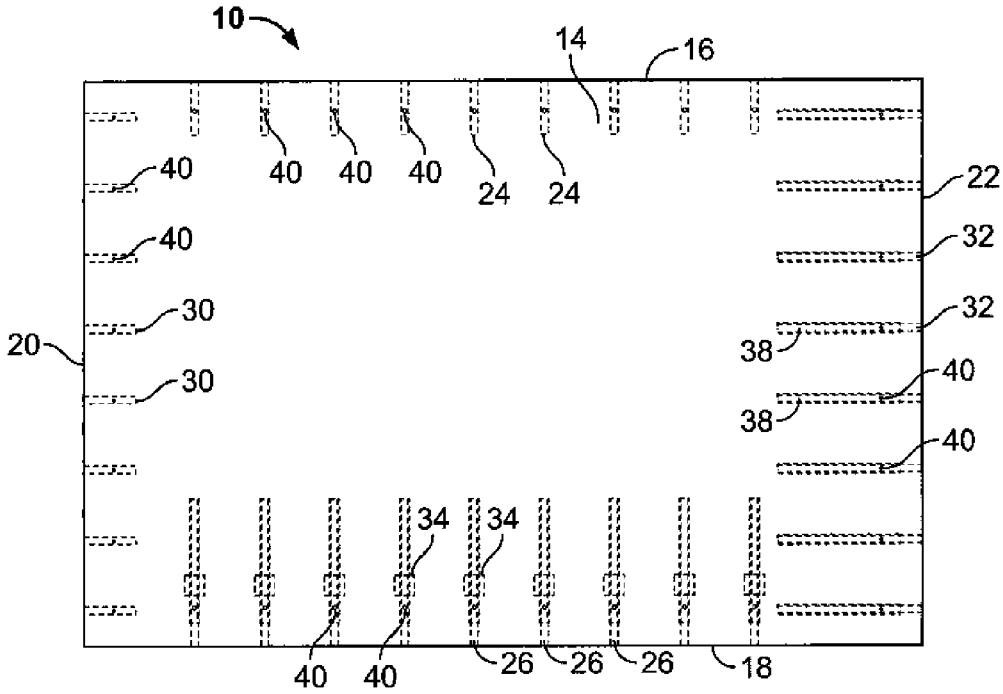
FIG. 3 is a bottom plan view of the pavement slab shown in FIG. 1.

FIGS. 1 through 3 illustrate a pavement slab 10 (hereinafter "the slab 10") which is constructed in accordance with the present invention. The slab 10 is fabricated with concrete in a conventional manner with reinforcing bars (not shown) interspersed in the concrete. In an embodiment, the slab 10 has a rectangular-shaped planar top surface 12 and a rectangular-shaped bottom surface 14. First and second longitudinal side surfaces 16, 18, and first and second transverse side surfaces 20, 22 form the perimeter of the slab 10. In an embodiment, the slab 10 can consist of other shapes and sizes. In an embodiment, the slab 10 is positioned on grade, which is prepared by means known in the art. In an embodiment, the bottom surface 14 includes grout channels formed therein for facilitating the distribution of grout (not shown in the Figures).

In an embodiment, a first and second plurality of transverse dowel bar holes 24, 26, respectively, are formed in the slab 10, proximate to the first and second longitudinal sides 16, 18, respectively, and approximately midway between the top surface 12 and the bottom surface 14. In an embodiment, each of the first and second transverse dowel bar holes 24, 26 is tubular-shaped. In other embodiment, each of the first and second plurality of transverse dowel bar holes 24, 26 can consist of other shapes and sizes. Each of the transverse dowel bar holes 24, 26 is sized and shaped to receive slidingly a corresponding one of a plurality of dowel bars 28 (not shown in MS. 1 through 3, but see, for example, FIGS. 8A through 9B). In an embodiment, each of the plurality of dowel bars 28 is tubular-shaped. In other embodiments, each of the plurality of dowel bars consists of other shapes and sizes. In an embodiment, the length of each of the transverse dowel bar holes 26 that is formed proximate to the second longitudinal side 18 is approximately one and one-half times the length of its corresponding one of the dowel bars 28, and the length of each of the transverse dowel bar holes 24 that is formed proximate to the first longitudinal side 16 is approximately one-half the length of its corresponding one of the dowel bars 28. In other embodiments, the transverse dowel bar holes 24, 26 can consist of other suitable lengths.

In an embodiment, a first and second plurality of longitudinal dowel bar holes 30, 32 is formed in the slab 10, proximate to the first and second transverse sides 20, 22, respectively, and approximately midway between the top surface 12 and the bottom surface 14. In an embodiment, each of the plurality of longitudinal dowel bar holes 30, 32 is tubular-shaped. In other embodiments, each of the plurality of longitudinal dowel bar holes 30, 32 consists of other shapes and sizes. Each of the longitudinal dowel bar holes 30, 32 is sized and shaped to receive slidingly a corresponding one of the tubular-shaped dowel bars 28. In an embodiment, the length of each of the longitudinal dowel bar holes 32 that is formed proximate to the second transverse side 22 is approximately one and one-half times the length of its corresponding one of the dowel bars 28, and the length of each of the longitudinal dowel bar holes 30 that is formed proximate to the first transverse side 20 is approximately one-half the length of its corresponding one of the dowel bars 28. In other embodiments, the longitudinal dowel bar holes 30, 32 can consist of other suitable lengths.

Figure 8A:
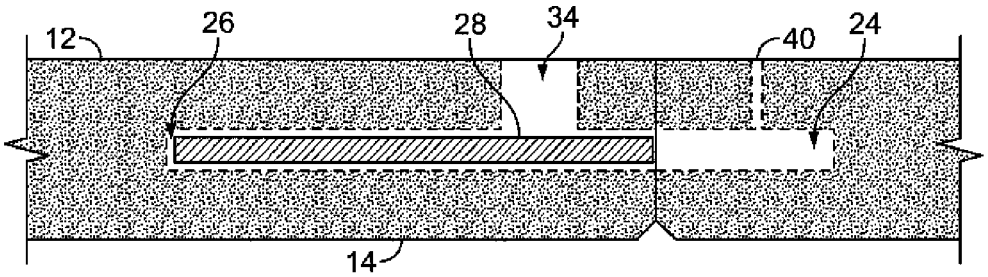
FIG. 8A is a cross-sectional view, taken along the section line E-E of FIG. 10 and looking in the direction of the arrows, of adjacent pavement slabs with the pavement slab on the left having a dowel bar positioned in a dowel bar hole.
Figure 8B:
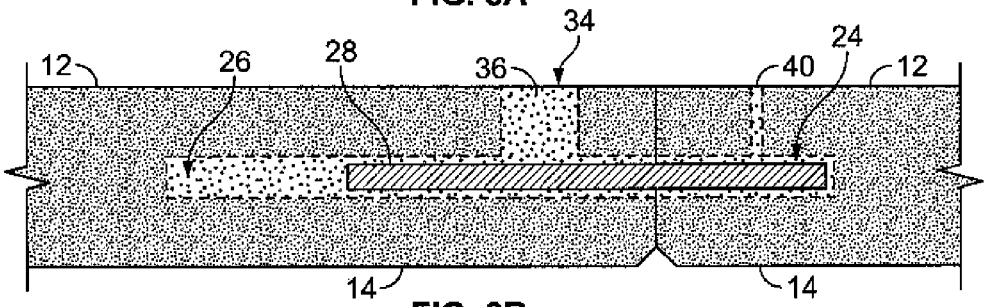
FIG. 8B is a cross-sectional view similar to FIG. 8A except the dowel bar is positioned across the joint which is grouted.

In an embodiment, a plurality of pockets 34 is formed in the top surface 12. In an embodiment, each of the plurality of pockets 34 is square-shaped. In other embodiments, each of the plurality of pockets 34 consists of other shapes and sizes. Each of the pockets 34 extends to the bottom of a corresponding one of the transverse dowel bar holes 26. Each of the pockets 34 permits a tool (e.g., a crowbar, etc.) to be inserted therethrough and into the corresponding dowel bar hole 26 to facilitate the positioning (i.e. sliding) of the corresponding dowel bar 28 inserted therein to form a joint between a plurality of adjacent slabs 10. More particularly, FIG. 8A shows one of the dowel bars 28 in its initial non-jointed, retracted position (i.e., disengaged from another adjacent slab 10), and FIG. 8B shows the dowel bar 28 in its jointed, extracted position (i.e., engaged with the another adjacent slab 10) in which one end of the dowel bar 28 protrudes from the slab 10 and an opposite end engages another adjacent slab 10. The pocket 34 also provides an opening for pumping a fluidable non-shrinkable grout 36 (see, for examples FIGS. 8B and 9B) into the corresponding dowel bar hole 26 and joint, once the joint is formed between the slabs 10, to stabilize and fasten the joint.

Figure 9A:
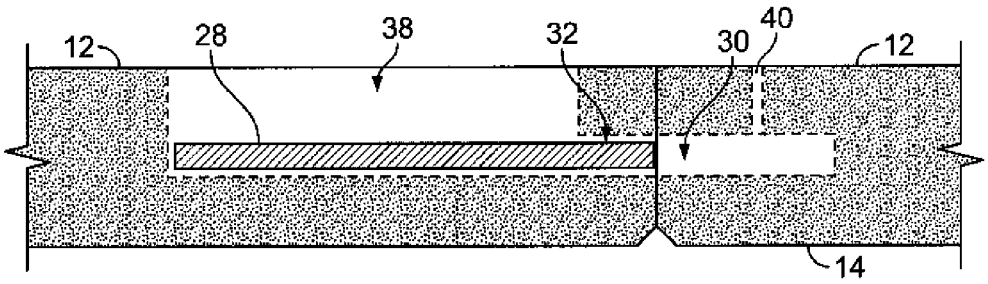
FIG. 9A is a cross-sectional view, taken along the section line G-G of FIG. 10 and looking in the direction of the arrows, of adjacent pavement slabs with the pavement slab on the left having a dowel bar positioned in its dowel bar slot.
Figure 9B:
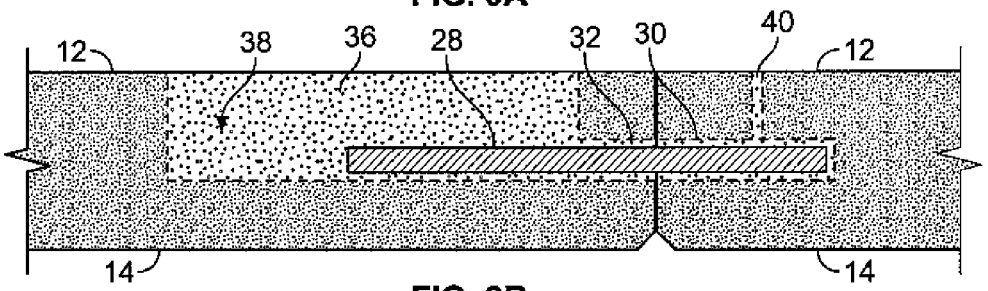
FIG. 9B is a cross-sectional view similar to FIG. 9A except the dowel bar is positioned across the joint which is grouted.

In an embodiment, a plurality of slots 38 is formed in the top surface 12 of the slab 10. In an embodiment, each of the plurality of slots 38 is rectangular-shaped. In other embodiments, each of the plurality of slots 38 consists of other shapes and sizes. Each of the slots 38 extends to the bottom of its corresponding one of the dowel bar holes 32. In an embodiment, a length of each of the slots 38 is shorter than a length of its corresponding one of the dowel bar holes 32. Each of the slots 38 permits a corresponding dowel bar 28 to be placed into the dowel bar hole 32 and then to be maneuvered (i.e., slid) into position to form a joint between adjacent slabs 10. More particularly, FIG. 9A shows one of the dowel bars 28 in its initial non jointed position, and FIG. 9B shows the dowel bar 28 in its jointed position. In an embodiment, each of the slots 38 is sized and shaped to receive a tool therethrough for facilitating the maneuverability of its corresponding dowel bar 28 positioned therein. The slot 38 also permits grout 36 to be pumped into the slot 38 and the corresponding dowel bar hole 32, once the joint is formed between the slabs 10, to fasten the joint.

In an embodiment, a plurality of grout fill holes 40 (see FIGS. 1 through 3, and FIGS. 8A through 9B)) is formed in the top surface 12 of the slab 10 to facilitate the pumping of the grout 36 into their corresponding dowel bar holes 24, 26, which are formed proximate to the first and second longitudinal sides 16, 18, respectively, and the pumping of the grout 36 into their corresponding dowel bar holes 30, 32, which are formed proximate to the first and second transverse sides 20, 22, respectively.

Figure 4:
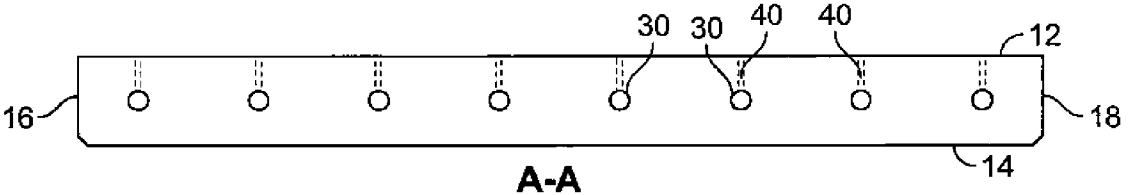
FIG. 4 is a cross-sectional view, taken along the section line A-A of FIG. 2 and looking in the direction of the arrows, of the pavement slab shown in FIG. 2 showing longitudinal dowel bar holes.
Figure 5:
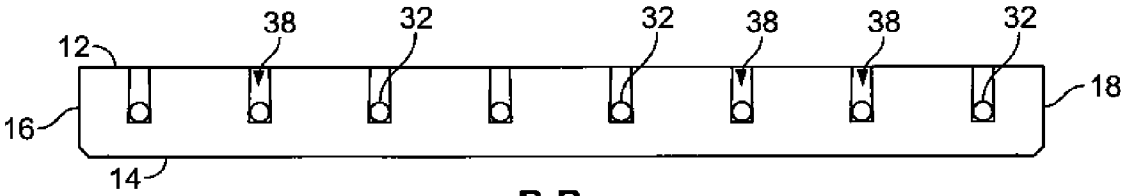
FIG. 5 is a cross-sectional view, taken along the section line B-B of FIG. 2 and looking in the direction of the arrows, of the pavement slab shown in FIG. 2 showing longitudinal dowel bar slots.
Figure 6:
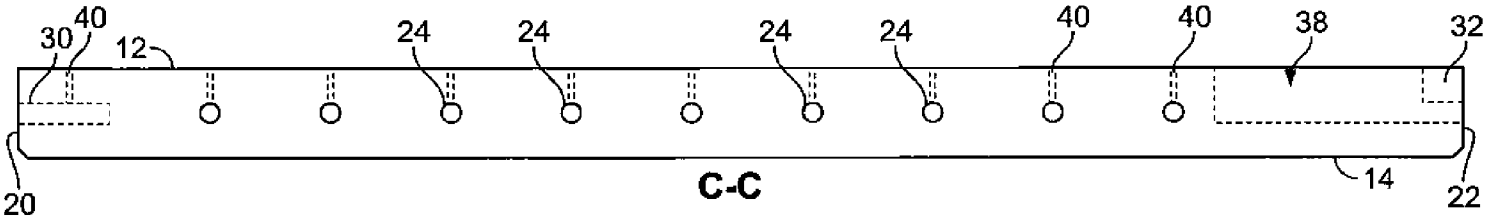
FIG. 6 is a cross-sectional view, taken along the section line C-C of FIG. 2 and looking in the direction of the arrows, of the pavement slab shown in FIG. 2 showing transverse dowel bar holes.
Figure 7:
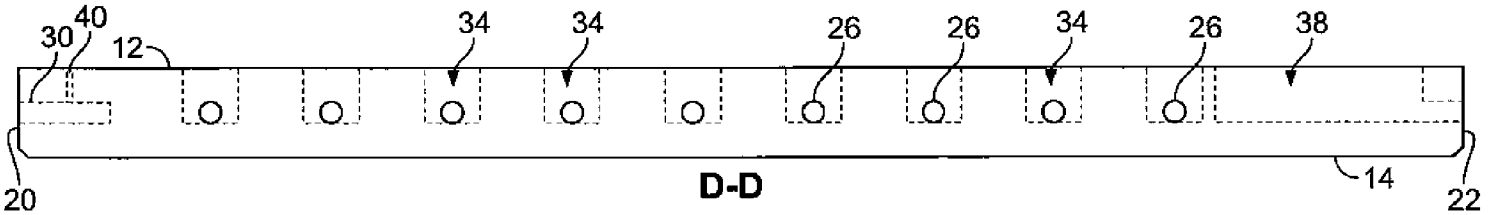
FIG. 7 is a cross-sectional view, taken along the section line D-D of FIG. 2 and looking in the direction of the arrows, of the pavement slab shown in FIG. 2 showing transverse dowel bar holes.

FIGS. 4 through 7 show the positioning of the dowel bar holes 24, 26, 30, and 32, the pockets 34, and the slots 38. More particularly, FIGS. 4 and 5 depict the positioning of the longitudinal dowel bar holes 30, 32, respectively, each of which is sized and shaped to receive a corresponding one of the dowel bars 28. FIG. 5 illustrates the positioning of the longitudinal slots 24. FIGS. 6 and 7 depict the positioning of the dowel holes 24, 26, respectively, each of which are sized and shaped to receive a corresponding one of the dowel bars 28. In an embodiment, the dowel bars 28 are made of A-36 steel or other suitable grade of material. In an embodiment, the dowel bars 28 may be coated with a corrosion inhibitor.

Figure 10:
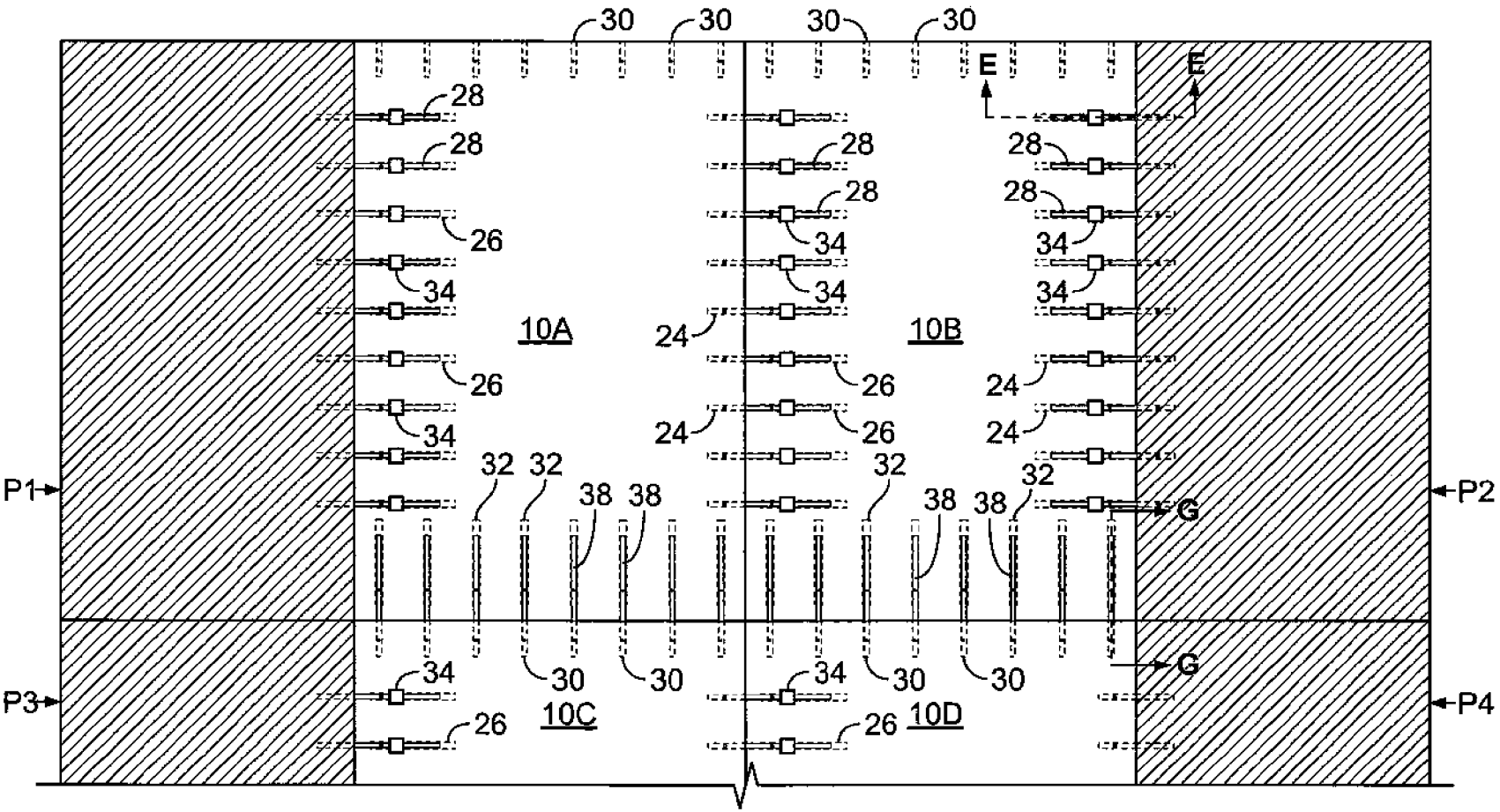
FIG. 10 is a plan view of pavement and paving slabs in which the dowel bars are not extended to form joints between the pavement and paving slabs.
Figure 11:
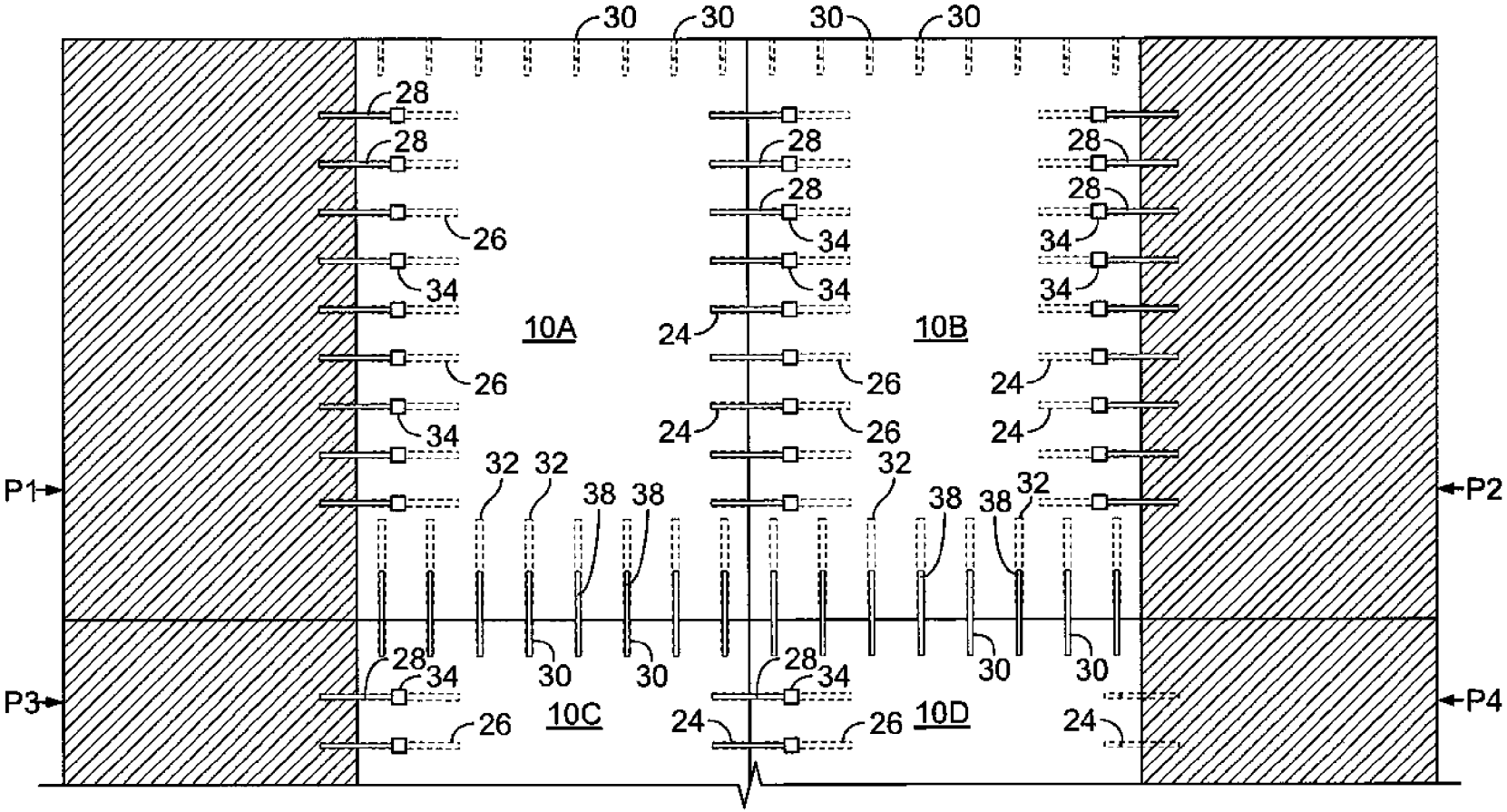
FIG. 11 is a plan view of pavement and paving slabs which is similar to FIG. 10 except the dowel bars are extended to form joints between the pavement and paving slabs. It should be understood that the dowel are depicted with solid lines rather than phantom for the purpose of clarity.

FIG. 10 depicts an embodiment of an array of slabs 10A through 10D, and preexisting pavement P1, P2, P3 and P4 positioned contiguous to each other, but not yet joined to one another. More particularly, prior to installation of the slabs 10A through 10B, the installation process includes first drilling dowel bar holes into the ends of preexisting pavement P1, P2, P3 and P4. The slabs 10A through 10D are then positioned adjacent to pavement P1, P2, P3, and P4, as shown in FIG. 10. Each of the dowel bars 28 is then placed in its corresponding one of the slots 26, 38 of slabs 10A through 10B. All of the dowel bars 28 are then slid from their non-jointed positions into their jointed positions (see FIG. 11). More particularly, each of the dowel bars 28 positioned within its corresponding one of the holes 26 of the slab 10B is slid into its jointed position to engage one of the corresponding holes 24 of the slab 1 OA, as well to engage the holes of adjacent pavement P2. The pockets 34 facilitate the maneuvering of the dowel bars 28 by permitting receipt of a tool therein. In addition, each of the dowel bars 28 positioned within its corresponding one of the holes 32 of the slab 10B is slid into its jointed position to engage one of the corresponding holes 30 of the slab 10D. The slots 38 facilitate the maneuvering of the dowel bars 28 by permitting receipt of a tool therein.

Similarly, each of the dowel bars 28 positioned within its corresponding one of the holes 26 of the slab 10A is slid into its jointed position to engage one of the corresponding holes of adjacent pavement P1, with the pockets 34 facilitating the maneuvering of the dowel bars 28 by permitting receipt of a tool therein. In addition, each of the dowel bars 28 positioned within its corresponding one of the holes 32 of the slab 10A is slid into its jointed position to engage one of the corresponding holes 30 of the slab 10C, with the slots 38 facilitating the maneuvering of the dowel bars 38 by permitting receipt of a tool therein. The slab 10C is joined to pavement P3, and slab 10D is joined to slab 10C and pavement P4 in a manner similar to that described above. In an embodiment, grout is then pumped into the slots 38, the pockets 34 and the grout fill holes 40 of the slabs 10A, 10B, 10C, and 10D to complete the installation. It is understood that, based on the specific pavement construction and or repair requirements, the configuration, positioning and arrangement of the dowel bar holes 24, 26, 30, and 32, the pockets 34, and the slots 38 may be different than the positioning and arrangement which is depicted in FIGS. 4 through 7. For example, in various embodiments, the pockets 34 can be substituted by the slots 38, and vice-versa. In other embodiments, the pockets 34 and the slots can consist of different shapes and sizes.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A pavement slab, comprising:

a top surface, a bottom surface opposite the top surface, first and second longitudinal side surfaces, each of which extends from the top surface to the bottom surface, and first and second transverse side surfaces, each of which extends from the top surface to the bottom surface;

a first plurality of transverse holes formed within the first longitudinal side surface, each of which includes a first end and a second end opposite thereof, and a second plurality of transverse holes formed within the second longitudinal side surface, each of which includes a first end and a second end opposite thereof;

a first plurality of pockets, each of which extends perpendicularly from the top surface to a corresponding one of the second plurality of transverse holes intermediate the first and second ends of the corresponding one of the second plurality of transverse holes;

a first plurality of longitudinal holes formed within the first transverse side surface, and second plurality of longitudinal holes formed within the second transverse side surface; and a plurality of dowel bars, wherein each of the second plurality of transverse holes is sized and shaped to receive slidably a corresponding one of the plurality of dowel bars, and each of the second plurality of longitudinal holes is sized and shaped to receive slidably a corresponding one of the plurality of dowel bars, wherein each of the plurality of dowel bars positioned within its corresponding one of the second plurality of transverse holes is slidable between a retracted position, in which the dowel bar is positioned within its corresponding one of the second plurality of transverse holes, and an extracted position, in which one end of the dowel bar extends from its corresponding one of the second plurality of transverse holes and into a hole of a first external structure, and wherein each of the plurality of dowel bars positioned within its corresponding one of the second plurality of longitudinal holes is slidable between a retracted position, in which the dowel bar is positioned within its corresponding one of the second plurality of longitudinal holes, and an extracted position, in which one end of the dowel bar extends from its corresponding one of the second plurality of longitudinal holes and into a hole of a second external structure.

2. The pavement slab of claim 1, wherein a length of each of the second plurality of transverse holes is approximately one and one-half times a length of the corresponding one of the plurality of dowel bars positioned therein, and a length of each of the second plurality of longitudinal holes is approximately one and one-half times a length of the corresponding one of the plurality of dowel bars positioned therein.

3. The pavement slab of claim 1, wherein each of the second plurality of transverse holes is formed approximately midway between the top surface and the bottom surface, and each of the second plurality of longitudinal holes is formed approximately midway between the top surface and the bottom surface.

4. The pavement slab of claim 3, further comprising a plurality of slots, each of which extends from the top surface to a corresponding one of the second plurality of longitudinal holes.

5. The pavement slab of claim 1, further comprising a second plurality of pockets, each of which extends perpendicularly from the top surface to a corresponding one of the first plurality of transverse holes intermediate the first and second ends of the corresponding one of the first plurality of transverse holes.

6. The pavement slab of claim 1, further comprising a first plurality of slots, each of which extends from the top surface to a corresponding one of the first plurality of transverse holes, and a second plurality of slots, each of which extends from the top surface to a corresponding one of the first plurality of longitudinal holes.

7. The pavement slab of claim 1, wherein each of the first plurality of transverse holes and each of the first plurality of longitudinal holes is sized and shaped to receive slidably a corresponding one of the plurality of dowel bars.

8. The pavement slab of claim 7, wherein a length of each of the first plurality of transverse holes is approximately one-half times a length of the corresponding one of the plurality of dowel bars to be received therein, and a length of each of the first plurality of longitudinal holes is approximately one-half times a length of the corresponding one of the plurality of dowel bars to be received therein.

9. The pavement slab of claim 8, further comprising a plurality of grout fill holes, each of which extends from the top surface to a corresponding one of the first and second plurality of transverse holes and the first and second plurality of longitudinal holes.

10. The pavement slab of claim 7, wherein the first and second external structures are second and third pavement slabs.

11. The pavement slab of claim 1, wherein the first and second external structures are preexisting pavement.

12. A pavement slab system, comprising:

a first pavement slab and a second pavement slab, each of the first and second pavement slabs including a top surface, a bottom surface opposite the top surface, first and second longitudinal side surfaces, each of which extends from the top surface to the bottom surface, and first and second transverse side surfaces, each of which extends from the top surface to the bottom surface, a first plurality of transverse holes formed within the first longitudinal side surface, and a second plurality of transverse holes formed within the second longitudinal side surface, each of which includes a first end and a second end opposite thereof, a first plurality of longitudinal holes formed within the first transverse side surface, and second plurality of longitudinal holes formed within the second transverse side surface, a first plurality of pockets, each of which extends perpendicularly from the top surface to a corresponding one of the second plurality of transverse holes intermediate the first and second ends of the corresponding one of the second plurality of transverse holes, and a plurality of dowel bars, wherein each of the first plurality of transverse holes and each of the first plurality of longitudinal holes is sized and shaped to receive slidably a corresponding one of the plurality of dowel bars, wherein each of the second plurality of transverse holes and each of the second plurality of longitudinal holes is sized and shaped to receive slidably a corresponding one of the plurality of dowel bars, and wherein each of the plurality of dowel bars positioned within its corresponding one of the second plurality of transverse holes of the first pavement slab is slidable between a retracted position, in which the dowel bar is positioned within its corresponding one of the second plurality of transverse holes, and an extracted position, in which one end of the dowel bar extends from its corresponding one of the second plurality of transverse holes and is positioned within a corresponding one of the first plurality of transverse holes of the second pavement slab.

13. The pavement slab system of claim 12, further comprising a third pavement slab, wherein each of the plurality of dowel bars positioned within its corresponding one of the second plurality of longitudinal holes of the first pavement slab is slidable between a retracted position, in which the dowel bar is positioned within its corresponding one of the second plurality of longitudinal holes, and an extracted position, in which one end of the dowel bar extends from its corresponding one of the second plurality of longitudinal holes and is positioned within a corresponding one of a first plurality of longitudinal holes of the third pavement slab.

* * * * *